US007204382B2

(12) United States Patent
Cezeaux

(10) Patent No.: US 7,204,382 B2
(45) Date of Patent: Apr. 17, 2007

(54) DRINKING TUBE AND CAP ASSEMBLY

(76) Inventor: Thomas Edward Cezeaux, 15429 135th Pl. NE., Woodinville, WA (US) 98072-5512

( * ) Notice: Subject to any disclaimer, the term of this patent is extended or adjusted under 35 U.S.C. 154(b) by 170 days.

(21) Appl. No.: 10/932,581

(22) Filed: Sep. 1, 2004

(65) Prior Publication Data

US 2005/0056652 A1 Mar. 17, 2005

Related U.S. Application Data

(60) Provisional application No. 60/503,089, filed on Sep. 15, 2003.

(51) Int. Cl.
*B65D 51/16* (2006.01)

(52) U.S. Cl. ..... 215/229; 215/388; 215/309; 220/203.04; 220/367.1; 220/709; 220/714; 222/525; 222/562

(58) Field of Classification Search ..... 220/203.04, 220/203.07, 367.1, 705, 707, 709, 714; 215/260, 215/309, 311, 388; 222/522, 523, 524, 525, 222/562

See application file for complete search history.

(56) References Cited

U.S. PATENT DOCUMENTS

| | | | | | |
|---|---|---|---|---|---|
| 2,110,026 | A | * | 3/1938 | Rose | 222/525 |
| 2,186,457 | A | * | 1/1940 | Juffa | 141/332 |
| 2,815,879 | A | * | 12/1957 | Hermes | 215/12.1 |
| 3,019,932 | A | * | 2/1962 | Singiser | 215/309 |
| 3,173,566 | A | * | 3/1965 | Talbert | 215/229 |
| 3,521,796 | A | * | 7/1970 | Roy | 222/525 |
| 3,595,421 | A | * | 7/1971 | Sanchis | 215/309 |
| 3,628,697 | A | * | 12/1971 | Dowson | 222/111 |
| 3,840,153 | A | | 10/1974 | Devlin | |
| 4,139,130 | A | | 2/1979 | Glusker et al. | |
| 4,852,781 | A | | 8/1989 | Shurnick et al. | |
| 4,971,048 | A | | 11/1990 | Seekins | |
| 4,976,364 | A | | 12/1990 | Solomon | |
| 5,029,719 | A | | 7/1991 | Solomon | |
| 5,048,705 | A | | 9/1991 | Lynd et al. | |
| 5,085,349 | A | | 2/1992 | Fawcett | |
| 5,167,819 | A | * | 12/1992 | Iana et al. | 210/474 |
| 5,183,183 | A | * | 2/1993 | Hernandez | 222/175 |
| 5,215,231 | A | | 6/1993 | Paczonay | |
| 5,265,769 | A | | 11/1993 | Wilson | |
| 5,301,858 | A | | 4/1994 | Hollander | |
| 5,301,860 | A | | 4/1994 | Paczonay | |

(Continued)

*Primary Examiner*—Anthony D. Stashick
*Assistant Examiner*—James Smalley
(74) *Attorney, Agent, or Firm*—Christensen O'Connor Johnson Kindness PLLC

(57) ABSTRACT

A hydration system is disclosed for carrying readily dispensable fluids, such as water. A removable cap having an annular valve covers a container. A flexible tube is disposed through the center of the annular valve and extends generally to near the bottom of the container. A bite valve is attached to the end of the tube that is external to the container. When the annular valve is closed, the hydration system is substantially closed, preventing fluid loss. When the annular valve is opened, an air channel is created that allows air to enter the container, facilitating the flow of fluid from the container through the flexible tube. The annular valve may be a poppet-type valve having a valve stem that is movable between the closed position and the open position. The hydration system is sufficiently compact to be utilized with narrow-mouthed bottles.

16 Claims, 7 Drawing Sheets

U.S. PATENT DOCUMENTS 5,337,931 A * 8/1994 Kitterman ..... 222/525
5,431,308 A 7/1995 Tchen
5,462,194 A * 10/1995 Barnwell ..... 220/709
5,509,551 A * 4/1996 Terrell, II ..... 215/229
5,513,762 A * 5/1996 Janani ..... 215/229
5,651,471 A 7/1997 Green
5,727,714 A 3/1998 Fawcett
5,730,336 A 3/1998 Lerner
5,775,368 A 7/1998 Morino
5,816,457 A 10/1998 Croft
5,842,076 A * 11/1998 Glover et al. ..... 396/626
5,971,357 A 10/1999 Denton et al.
5,988,448 A * 11/1999 Foth ..... 222/189.09
6,032,831 A 3/2000 Gardner et al.
6,039,305 A * 3/2000 Hoskins et al. ..... 251/342
6,050,444 A 4/2000 Sugg
6,062,435 A 5/2000 Hess, III
6,070,767 A 6/2000 Gardner et al.
6,135,311 A 10/2000 Panec et al.
6,273,128 B1 8/2001 Paczonay
6,290,090 B1 9/2001 Essebaggers
6,523,711 B1 2/2003 Hughes et al.
6,739,484 B2 * 5/2004 Finley ..... 222/525
6,929,135 B1 * 8/2005 Hajianpour ..... 215/229
2002/0092858 A1 7/2002 Bowman
2003/0168462 A1 9/2003 Kiyota

* cited by examiner

DRINKING TUBE AND CAP ASSEMBLY

CROSS-REFERENCE TO RELATED APPLICATION

This application claims the benefit of provisional Application No. 60/503,089, filed Sep. 15, 2003, the benefit of which is hereby claimed under 35 U.S.C. § 119.

FIELD OF THE INVENTION

The present invention relates to the field of hydration systems and, more particularly, to vented hydration systems having a hard container with a flexible drinking tube.

BACKGROUND OF THE INVENTION

Water bottles and similar hydration systems are popular, particularly among outdoor athletes—for example, by persons engaged in hiking, biking, skating, etc. Hydration systems are convenient for rehydrating a person who has lost body fluids as a result of heat, physical exertion, arid environment, and/or the passage of time. There are two general types of hydration systems—(1) hard or rigid/semirigid container systems, and (2) soft or flexible bladder systems.

A hard container system includes a hard or semirigid container that is made from plastic, metal, glass, or another material that holds its shape when the container is empty. The container typically includes a removable lid, providing access to the contents of the container. Examples of such containers include, but are not limited to, NALGENE® brand bottles, sports cycle bottles, canteens, and glass bottles. Hard container systems provide many advantages. For example, hard containers can easily be cleaned and can hold a number of different liquids, including water. Because the container is generally rigid or semirigid, it is sturdy and difficult to puncture. Moreover, the container typically retains its shape in a backpack, even when other items are placed on top of the container. A rigid or semirigid container system can be transported separate from or away from the user—for example, in a water carrier on a bicycle. Alternatively, a hard container system can be mounted in a wearable carrier, allowing the weight of the liquid to be efficiently transferred to the user's hips.

Hard container systems, however, often require that the container be physically removed from a carrier or other support mechanism that holds the container. This may require the user to stop doing whatever physical activity is being performed or to substantially interrupt such activity in order to remove the container from its carrier or holder so that the user can rehydrate. Most rigid containers are carried in this fashion.

Another disadvantage of hard container systems is that for the liquid to be efficiently removed from a rigid or semirigid container, the container must be vented to permit air to enter the container in order to replace the volume of liquid being removed from the container. Without such a vent, the removal of the liquid will generally cause a partial vacuum to form in the container, impeding or completely preventing the flow of the liquid out of the container.

In many applications it is undesirable to have a vent that is always open. If the vent remains open during exposure to harsh environmental conditions, the vent could allow dirt to enter the container, resulting in contamination of the liquid. Dirt can also obstruct the vent, thereby rendering the vent inoperable. Therefore, the user may be required to open a vent prior to consuming the contents of the container, further interrupting the user's activities.

Systems have been proposed that incorporate automatically operable mechanical vents, e.g., check valves, that require a pressure differential that must be overcome to open the vent. These automatic vents, however, require additional pressure differential to extract the fluid and therefore add resistance to the overall system. In some rigid containers an extra-wide drinking opening is provided, such that the liquid egress and vent air can simultaneously pass through the same opening. Such containers however, can be difficult to drink from without spilling the contents.

To avoid some of the disadvantages discussed above, hard container hydration systems are sometimes equipped with an elongate, flexible drinking tube that extends from the container to the user's mouth. The tube may be quite long, and the elevation difference from the top of the container to the user's end of the tube (that may include a mouth dispenser) can often be several feet. This requires the user to suck the liquid through the length of the tube at each use. Some systems utilize a check valve to prevent the liquid from returning to the container, i.e., whereby a volume of liquid remains in the tube. Alternatively, some systems use motorized or manual pumps to force liquid through the liquid tube, while other systems require complicated valves either in the liquid tube or mouth dispenser.

Check valves and unidirectional valves have a set pressure differential that must be overcome for the valve to operate properly. For example, a check valve may use spring tension or the resilient nature of a plastic or rubber material to urge the valve to a closed position. This tension is typically preset so the pressure required to open the valve remains substantially constant. Similarly, if a liquid tube or vent contains an in-line check valve, the force to open the valve remains constant regardless of all other conditions in the system. Generally speaking, check valves are expensive to manufacture, degrade over time, malfunction when dirty, freeze easily, and allow fluid to flow in a single direction.

Moreover, some hard container systems with drinking tubes requiring the bottle to be inverted so that gravity can help pull air into the container when the user ceases to suck liquid from the drinking tube, are known in the art.

Soft bladder container systems overcome many of the disadvantages of hard container systems. A soft bladder container system typically includes a pliable liquid container or bladder that provides a liquid reservoir. The bladder is easily compressed, folded, or deformed. Examples of this type of system include, but are not limited to, the CAMELBAK® brand system, the PLATYPUS® brand system, bota bags, and collapsible water pails. The bladder or pliable container, however, generally requires some type of support when the container is filled with a liquid—for example, a backpack-type assembly. A tube is typically provided to the container, allowing the user to draw water to from the reservoir of the soft bladder system. An advantage of such soft bladder systems is that the user can rehydrate without stopping an activity. Because the soft bladder container is pliable, it can collapse as liquid is removed, obviating the need for a vent, and it is easier to draw liquid from the bladder because no check valve is required. In conventional, soft bladder container systems, the soft bladder must be operated with its tube at the container's lowest point in order for the bladder to be fully evacuated during use.

A disadvantage of soft bladder systems is that they are susceptible to punctures and leaks. While positioned upside down and supported inside a carrier pack, a leak can drain the bladder of liquid into vital gear, such as a sleeping bag or clothing. The flexible materials that are used to manufacture the soft bladder hydration systems are selected to withstand water but may deteriorate or absorb nonwater constituents present in other liquids. A soft bladder type of system is often transported on the back of the user, which may increase the risk of back fatigue and back injury. The construction of a soft bladder hydration system typically causes water to flow from the liquid dispenser when the bladder becomes compressed during use. In addition, a soft container is extremely difficult to clean. Many manufacturers of soft bladder hydration systems often offer secondary products such as patch kits, cleaning brushes, cleaning holders, and extensive cleaning chemicals for their systems.

There remains a need, therefore, for a hydration system that provides the advantages of ruggedness of rigid container systems while also providing the ease of use and availability of soft bladder container systems.

SUMMARY OF THE INVENTION

A water bottle type of hydration system is disclosed wherein the container is of a hard or rigid construction with an opening for filling the container. A removable cap closes the container. The cap includes a valve that provides an annular airflow path through the cap to provide an airflow path into the container when the contents of the bottle are being removed. An aperture is also provided through the middle of the valve, the aperture adapted to slidably and snugly accommodate an elongate flexible tube, such that one end of the tube extends into the container and the opposite end of the tube extends out of the container. The valve includes a tubular body portion that may be formed integral with the lid, and a valve stem that slidably engages the tubular body portion, the valve stem being movable between an open position wherein the annular airflow path is open, and a closed position wherein the annular airflow path is blocked. It will be appreciated that the valve, which may be a poppet-type valve, does not provide a convenient path for extracting liquid from the container as in prior art systems, but rather, the flexible tube provides a channel for extracting the liquid. The annular valve opens an airflow path to prevent the formation of a vacuum in the container that would inhibit the outflow of the liquid.

In an embodiment of the invention, the valve body includes an outer tube and a concentric inner tube, the outer and inner tubes defining a slot that slidably accommodates the valve stem.

In an embodiment of the invention, the valve includes a tactile indication to the user when the valve stem is in the open position.

In an embodiment of the invention, a bite valve is provided on the distal end of the flexible tube.

In an embodiment of the invention, the container is formed from a plastic such as polypropylene or polyethylene.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIGS. 2A and 2B illustrate a portion of the hydration system shown in FIG. 1, showing the poppet valve with the drinking tube inserted through the center of the valve, wherein FIG. 2A shows the poppet valve in the closed position and FIG. 2B shows the poppet valve in the open position;

FIGS. 3A and 3B illustrate a portion of an alternative embodiment of a hydration system according to the present invention, showing a poppet valve with a drinking tube inserted through the center of the valve, wherein FIG. 3A shows the poppet valve in the closed position and FIG. 3B shows the poppet valve in the open position;

DETAILED DESCRIPTION OF THE PREFERRED EMBODIMENT

Figure 1:
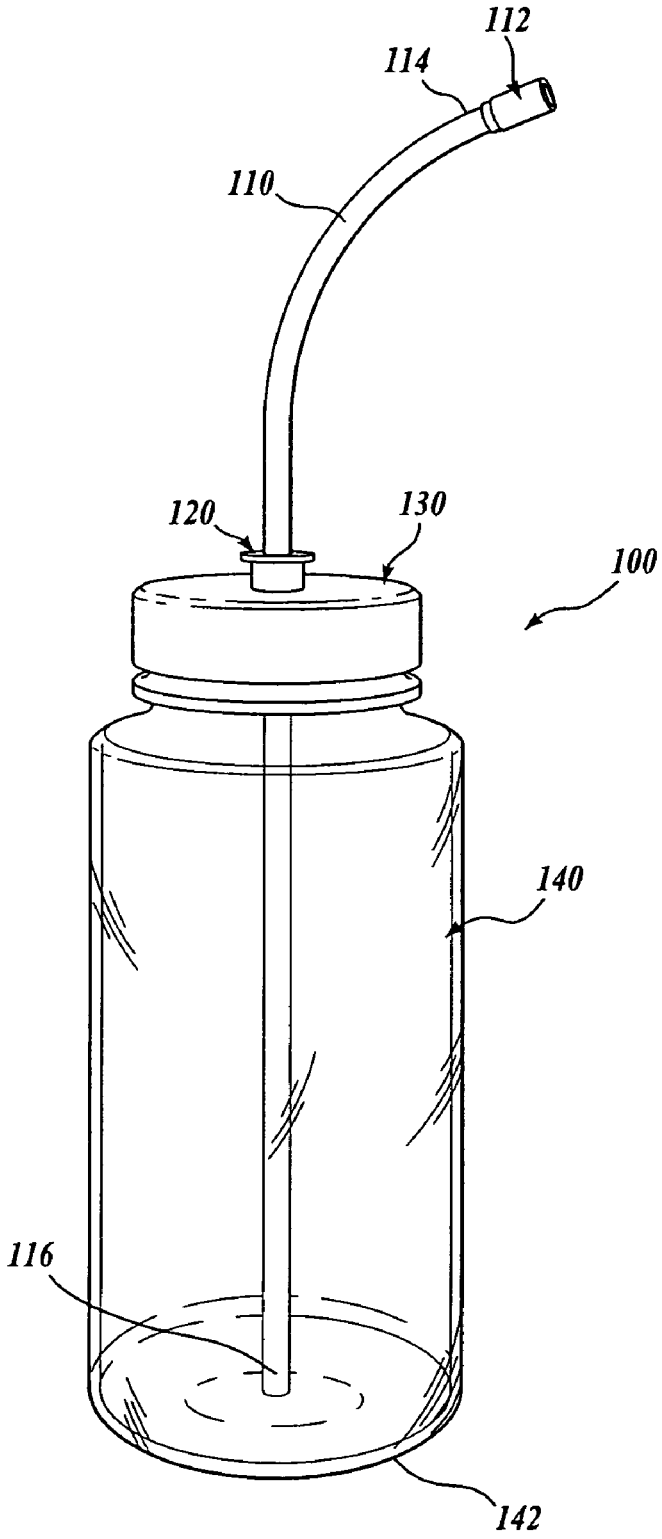
FIG. 1 shows a hydration system according to the present invention, including a substantially rigid container, a cap, an annular valve (poppet valve), a drinking tube inserted through the center of the valve, and a bite valve on the external end of the drinking tube.

A currently preferred embodiment of the present invention will now be described with reference to the figures, wherein like numbers indicate like parts. Referring to FIG. 1, a hard container type of hydration assembly 100 is shown. The hydration assembly 100 includes a rigid or semirigid container 140 that may be made of any suitable material. In a preferred embodiment, the container 140 is formed from a hard polymer such as a polypropylene or polyethylene. Alternatively, the container may be formed from another suitably hard polymer, glass, aluminum, or other relatively rigid material. The container 140 is substantially cylindrical and may include contoured portions to facilitate holding the container 140 or mounting the container 140 to a holder. The container 140 is closable at the top with a removable cap 130. For example, the container 140 and cap 130 may have cooperative threaded portions (not shown) for securely attaching the cap 130 to the container 140. The container 140 and cap 130 define a volume for containing a liquid such as water. Although the container 140 shown in FIG. 1 is a wide-mouthed container, a particular advantage of the present invention is that it is readily usable with necked or narrow-mouthed containers.

An annular valve 120 is provided on top of the cap 130, providing a closable opening to the atmosphere. The annular valve 120 is movable between an open position, wherein an airflow path to the volume enclosed by the container 140 is provided, and a closed position, wherein the enclosed volume is substantially sealed. The annular valve 120 may be of the type commonly called a "poppet valve." In contrast to prior known hydration systems, however, the annular valve 120 does not function as an exit for expelling liquid from the container 140, but rather provides a passage for air to enter the container 140 as liquid is removed, thereby preventing (or lessening) the formation of a vacuum within the container 140.

An elongate flexible drinking tube 110 extends concentrically through the annular valve 120. In the embodiment shown in FIG. 1, the flexible tube 110 is slidably disposed through the center of the valve 120 such that the tube may be adjusted to increase or decrease the portion of the tube disposed inside the container 140, e.g., so that the tube 110 may be positioned such that the proximal end 116 extends approximately to the bottom 142 of the container 140. A mouth-operated liquid dispenser such as a bite valve 112 may be attached to the distal end 114 of the flexible tube 110. The bite valve 112 is biased to a closed position such that liquid will flow through the valve 112 only when it is engaged by the user. It will be appreciated that, when the valve 112 is not engaged, fluids will be inhibited from flowing through the flexible tube 110 in either direction. Whereby fluid in the flexible tube 110 will tend not to flow back into the container 140 when the user releases the valve 112.

The annular valve 120 is preferably incorporated unitarily into the cap 130. As discussed above, the annular valve 120 may be a poppet-type valve. When the annular valve 120 is in the open position and the user draws liquid from the container 140 through the flexible tube 110, air will be drawn into the rigid container 140 through the annular valve 120, preventing a vacuum from forming and thereby facilitating the flow of liquid through the flexible tube 110.

Figure 2A:
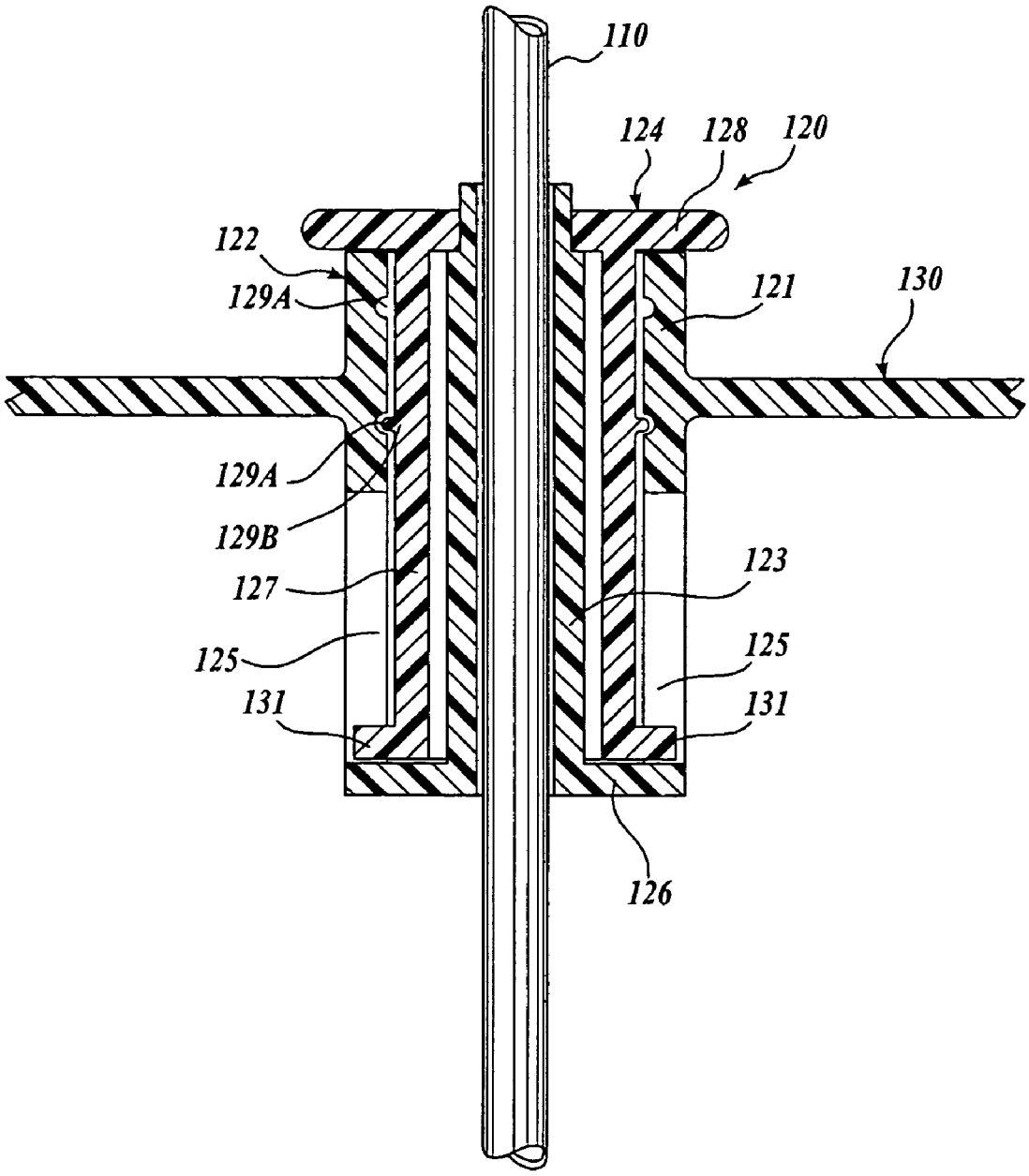
Figure 2B:
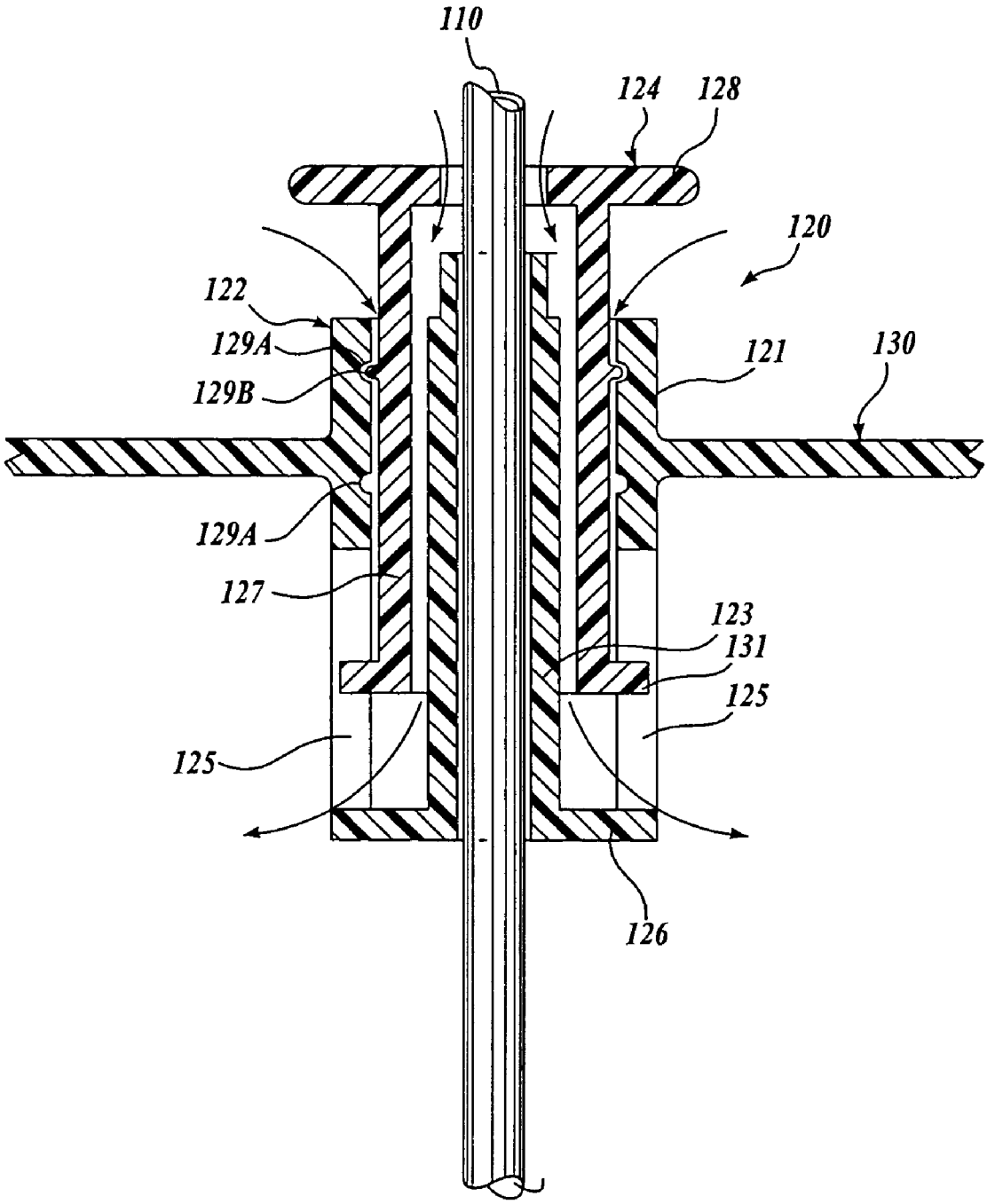

As seen most clearly in the cross-sectional views of the annular valve 120 shown in FIGS. 2A and 2B, the flexible tube 110 is disposed through the annular valve 120. This configuration provides a very compact system that can be utilized even on very small caps. The annular valve 120 includes a body portion 122 having an outer tube 121 and a concentric inner tube 123 connected by a horizontal seat portion 126, forming an annular space between the outer and inner tubes 121, 123. The outer tube 121 includes a plurality of transverse apertures 125 that provide a fluid path to the annular space between the outer and inner tubes 121, 123. The inner tube 123 defines an axial aperture that is sized to slidably and snugly receive the flexible tube 110. In the preferred embodiment, the body portion 122 of the annular valve 120 is formed integrally with the cap 130.

A valve stem 124 is provided, having a generally tubular lower portion 127 and an enlarged head portion 128. The lower portion 127 is slidably disposed in the annular space between the outer tube 121 and inner tube 123.

FIG. 2A shows the annular valve 120 in the closed position. In the closed position, the bottom edge of the valve stem 124 abuts the seat portion 126 of the valve body 122, and the head portion 128 of the valve stem 124 abuts the top of the outer tube 121 and the inner tube 123 of the valve body 122, thereby substantially closing the airflow path through the annular valve 120. It is contemplated that the head portion 128 of the valve stem 124 may include a recessed portion (not shown) adapted to receive the top end of the outer tube 121 and/or the seat portion 126 may include an annular recess (not shown) adapted to receive the bottom end of the valve stem 124.

FIG. 2B shows the annular valve 120 in the open position. In the open position, the valve stem 124 is disposed away from the seat portion 126 of the valve body 122, and the head portion 128 of the valve stem 124 is disposed away from the body portion 122 of the annular valve 120. As indicated by the arrows in FIG. 2B, when the annular valve 120 is in the open position, an annular airflow path is opened between the inner tube 123 of the valve body 122 and the lower portion 127 of the valve stem 124. The annular airflow path fluidly connects the volume enclosed by the container 140 (through the apertures 125) to the environment outside the container 140.

Optionally, the outer tube 121 of the annular valve 120 includes a pair of vertically-spaced channels or detents 129A that are positioned to receive a corresponding ridge or protrusion 129B on the outer surface of the valve stem lower portion 127, providing a tactile indication to the user when the valve stem 124 is in the upper and lower positions, respectively. It will be readily apparent to the artisan that the annular valve 120 may include additional aspects not shown in the figures for clarity and that are well known in the art. It will also be appreciated that the tactile indication provided by the detents 129A and protrusions 129B may be accomplished in any number of ways as are known in the art, or may not be included without departing from the present invention. For example, the valve stem 124 may include an outwardly extending retention tab 131 extending into the apertures 125, to further retain the valve stem 124 in the valve body portion 122.

It will be appreciated now that as the user draws liquid from the container 140 (FIG. 1) through the flexible tube 110, the low pressure caused by the removal of liquid from the container will cause air to be drawn through the annular airflow path into the container 140, thereby preventing a vacuum from forming and interfering with the egress of liquid from the container 140. The annular airflow path, however, is relatively narrow and will therefore prevent or limit the amount of liquid that might spill from the container 140 if the container 140 is inadvertently tipped over or inverted. Moreover, it will be appreciated that, due to the rigidity of the container 140, the container 140 will not readily deform sufficiently to expel a significant amount of fluid through the annular airflow path.

Figure 3A:
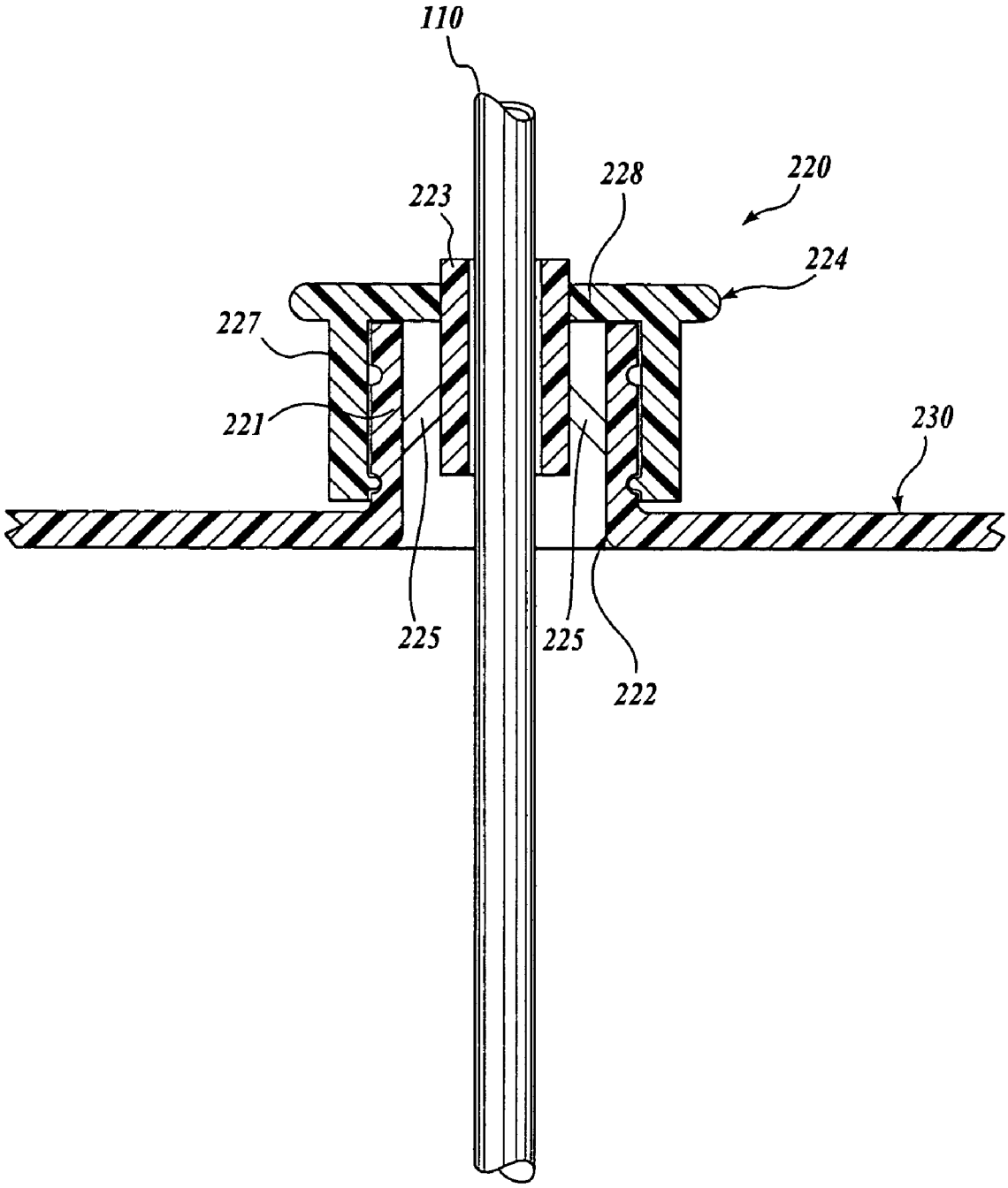
Figure 3B:
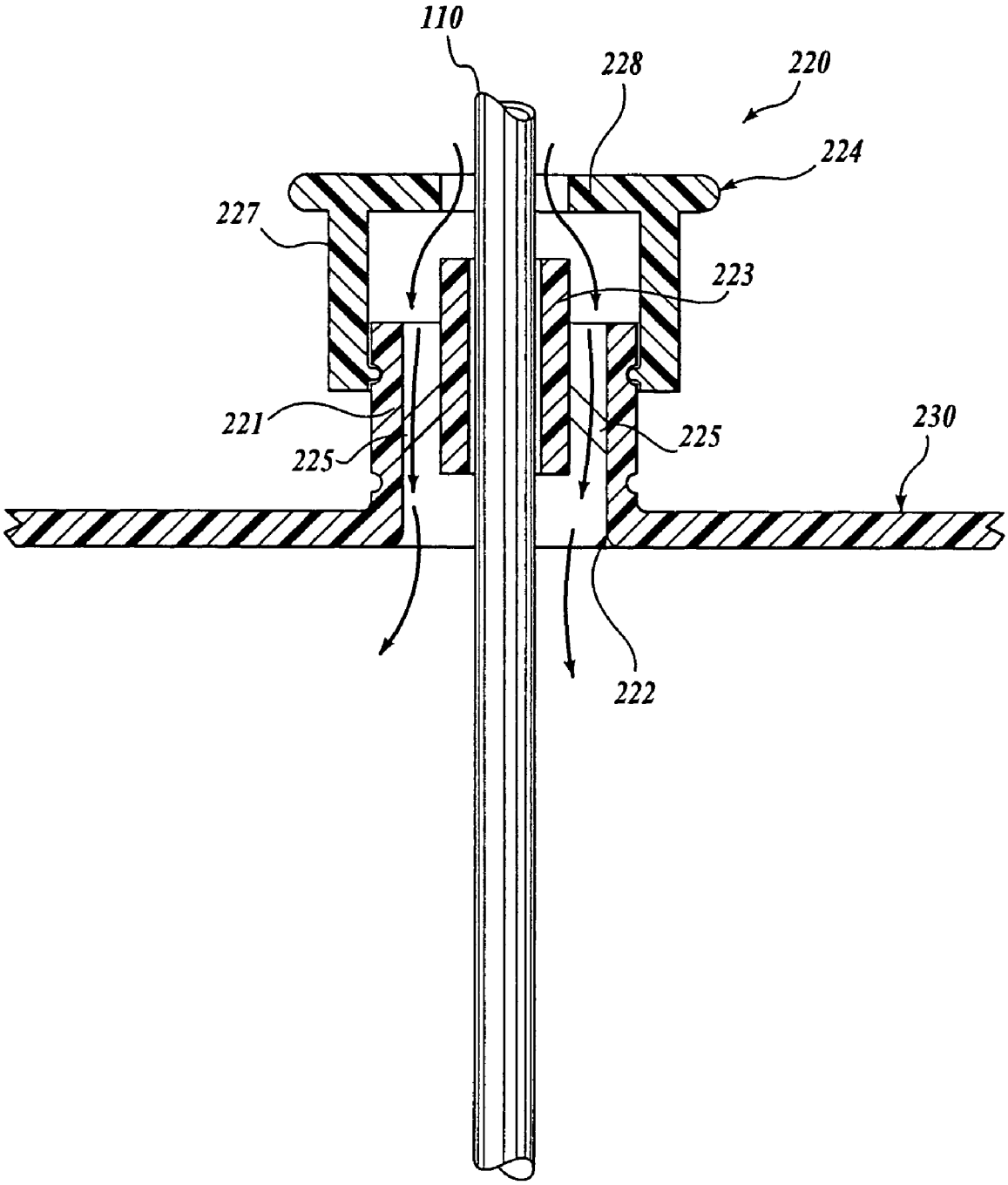

FIGS. 3A and 3B show a portion of a cap 230 and annular valve 220 showing an alternative embodiment of the present invention. The annular valve 220 includes a body portion 222, including an outer tube 221 and a concentric inner tube 223, the outer and inner tubes 223, 221 defining an airflow path therebetween. The inner tube 223 defines an axial aperture that is sized to slidably and snuggly receive the flexible tube 110. The inner tube 223 is connected to the outer tube 221 with a plurality of spaced legs 225. A valve stem 224 having a cylindrical lower portion 227 and an enlarged head 228 is slidably disposed on the body portion 222, such that the valve stem 224 can be moved between an open position and a closed position.

FIG. 3A is a cross-sectional view showing the annular valve 220 with the valve stem 224 in the closed position. In this closed position, the head 228 of the valve stem 224 abuts the top of the outer tube 221 and the side of the head 228 abuts the inner tube 223, thereby substantially closing the annular valve 224. FIG. 3B shows the annular valve 220 with the valve stem 224 moved upwardly, to the open position. In the open position, the head 228 of the valve stem 224 is disposed away from the inner and outer tubes 223, 221 of the valve body portion 222, thereby opening an airflow path through the annular valve 220.

In both the annular valve 120 shown in FIGS. 2A and 2B and the annular valve 220 shown in FIGS. 3A and 3B, the valves 120, 220 are opened by pulling upwardly on the respective valve stems 124, 224 and closed by pushing down on the valve stems 124, 224. When the valve stems 124, 224 are in the upward position, an annular airflow passageway is opened through the caps 130, 230.

Figure 4:
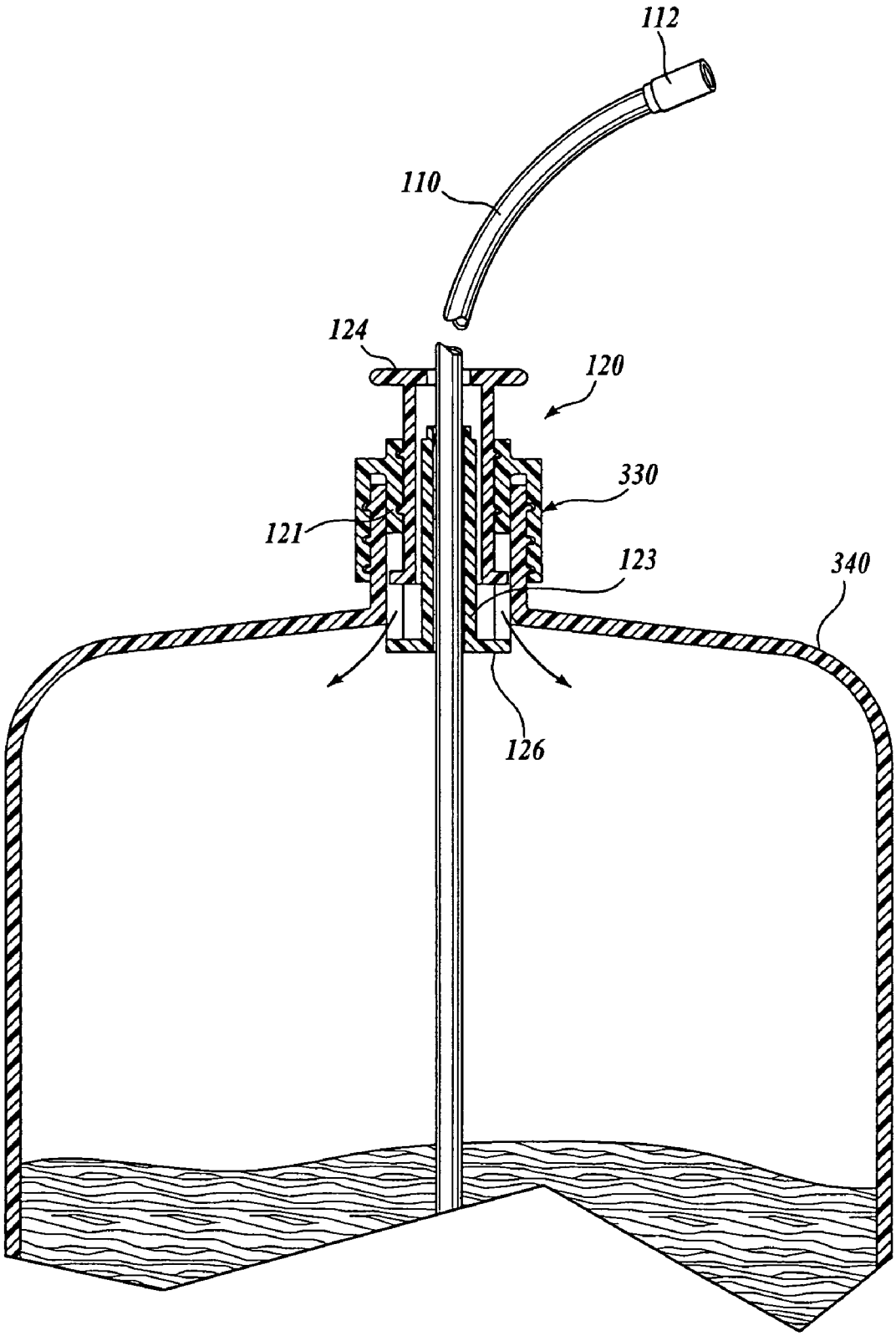
FIG. 4 shows an alternative embodiment of a hydration system according to the present invention, wherein the container is a narrow-mouth bottle and the cap and valve are relatively small.

The unique, compact design of the disclosed hydration assembly 100 allows for use on a wider array of containers than previous solutions. For example, it will be appreciated that the present invention may be incorporated into a very small cap, such as that used on many narrow-mouthed beverage bottles. This compact design will allow for an inexpensive hydration assembly that is easy to manufacture and takes advantage of existing tooling. FIG. 4 shows the annular valve 120 incorporated into a cap 330 for a narrow-mouthed bottle 340. It will be appreciated that the bottle 340 may be relatively thin-walled and flexible. The cap 330 is threadably attached to the bottle 340 and includes the valve body portion 122 having an outer tube 121, inner tube 123, and a seat portion 126, generally described above and as shown in FIGS. 2A and 2B. The valve stem 124 is slidably disposed in the annular gap between the outer and inner tubes 121, 123, opening an annular airflow path when the valve stem 124 is in the open position and substantially closing the annular flow path when the valve stem 124 is in the closed position. Although the annular valve 120 is shown in FIG. 4, it will be appreciated that the narrow-mouth version of the present invention may alternatively utilize, for example, the annular valve 220 shown in FIGS. 3A and 3B.

The present invention may be used as a replacement cap for a conventional, disposable water (or other beverage) bottle. In particular, because the flexible tube 110 is slidably disposed through the center of the annular valve 120, the same cap 330 and valve 120 may be used with different-sized bottles. For example, a user might purchase a smaller bottle of water for a brief excursion and replace the lid of the disposable bottle with the cap 330 shown in FIG. 4. For another, longer excursion, the user may purchase a larger bottle of water and use the same cap 330, sliding the flexible tube 110 to reach generally to the bottom of the larger bottle.

Figure 5:
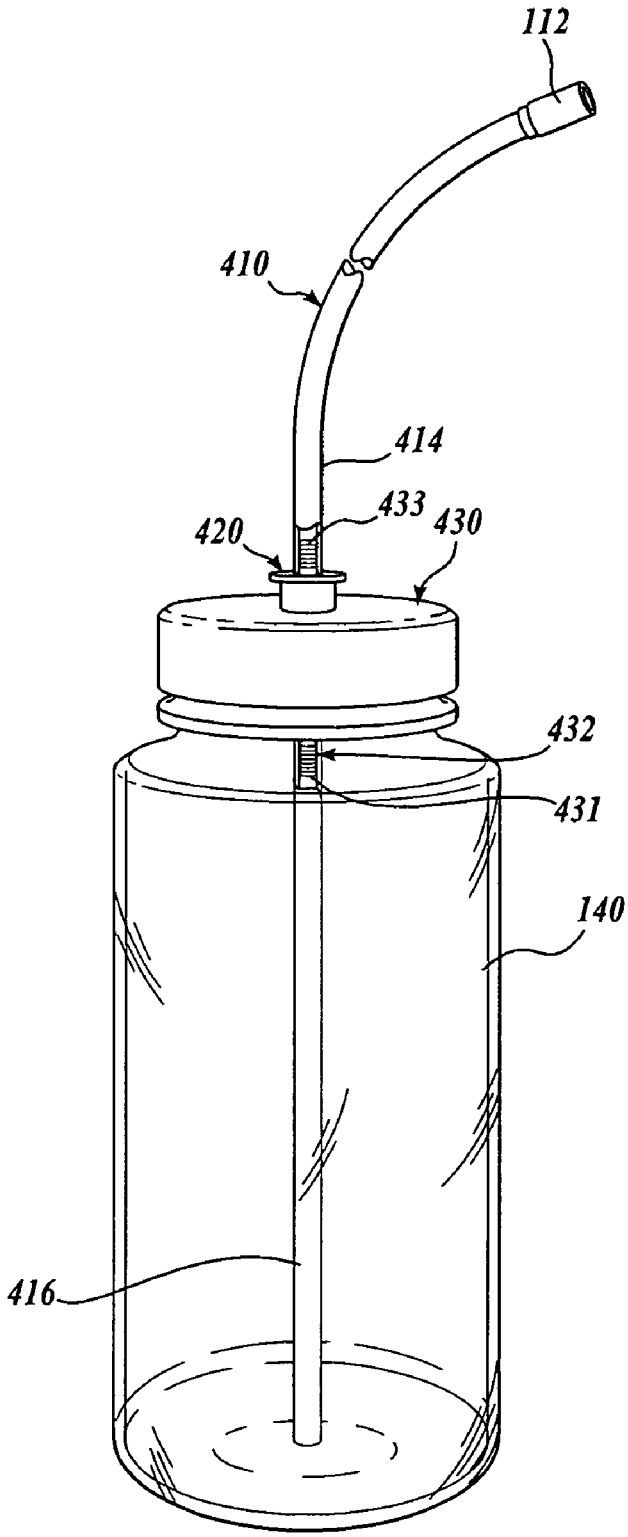
FIG. 5 shows another alternative embodiment of a hydration system according to the present invention, wherein the drinking tube has separable proximal and distal portions.

FIG. 5 shows another alternative embodiment of the present invention, wherein a hydration system 400 with the above described rigid or semirigid container 140, attaches to a cap 430. The cap 430 includes a two-piece flexible tube 410 having a proximal portion 416 that is separate from the distal portion 414. The cap 430 includes an annular valve 420 similar to the annular valve 120 shown in FIG. 2A, but wherein the inner tube 432 includes oppositely extending rigid tube connectors 431, 433. In this embodiment, the proximal portion 416 of the flexible tube 410 attaches to the downwardly extending tube connector 431 and the distal portion 414 attaches to the upwardly extending tube connector 433, defining a continuous passageway therethrough. The flexible tube 410 may include a bite valve 112 at its distal end.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A hydration system comprising:

a rigid container having an opening, the container being adapted to contain a liquid;

a cap removably attachable to the container and adapted to cover the opening;

a valve disposed through the cap, the valve defining an annular airflow path through the cap, wherein the valve includes a tubular body portion and a valve stem that slidably engages the tubular body portion, the valve stem being movable axially between an open position wherein the annular airflow path provides an airflow path into the container, and a closed position wherein the annular airflow path is blocked, the valve further having a central aperture that is surrounded by the annular airflow path; and a flexible tube having a proximal end and a distal end, the flexible tube extending snugly through the central aperture in the valve such that the proximal end of the flexible tube extends into the container when the cap is attached to the container;

wherein the tubular body portion of the valve includes an outer tube and a concentric inner tube, the inner tube defining the central aperture that receives the flexible tube.

2. The hydration system of claim 1, wherein the tubular body portion of the valve is formed integrally with the cap.

3. The hydration system of claim 1, wherein the valve further comprises means for providing a tactile indication when the valve stem is in the open position.

4. The hydration system of claim 1, further comprising a bite valve disposed on the distal end of the flexible tube.

5. The hydration system of claim 1, wherein the container is formed from polypropylene.

6. The hydration system of claim 1, wherein the outer tube and concentric inner tube form an annular volume therebetween and a seat portion interconnecting the inner tube and the outer tube.

7. The hydration system of claim 6, wherein the valve stem includes a lower portion that is partially disposed in the annular volume between the inner tube and the outer tube of the tubular body portion, and wherein the lower portion abuts the seat portion of the tubular body portion when the valve is in the closed position.

8. The hydration system of claim 7, wherein the valve stem further includes a head portion having a diameter greater than the lower portion and wherein the head portion abuts the outer tube of the tubular body portion when the valve stem is in the closed position.

9. A hydration assembly comprising:

a substantially rigid bottle having an open upper end, the bottle being adapted to hold a liquid;

a cap removably attachable to the bottle;

an annular valve means providing a closable air passage through the cap, the annular valve means including a body portion and a valve stem slidably disposed on the body portion, wherein the annular valve means defines an annular airflow path through the cap, and the valve stem being movable axially between an open position and a closed position, the body portion further having an aperture through the cap that is approximately concentric with the annular airflow path; and an elongate tube slidably disposed through the aperture in the body portion of the annular valve;

wherein the body portion of the annular valve means includes an outer tube and a concentric inner tube, the inner tube defining the aperture that slidably receives the elongate tube.

10. The hydration system of claim 9, wherein the body portion of the annular valve means is formed integrally with the cap.

11. The hydration system of claim 9, wherein the annular valve means further provides a tactile indication when the valve stem is in the open position.

12. The hydration system of claim 9, further comprising a bite valve disposed on the elongate tube.

13. The hydration system of claim 9, wherein the container is formed from a polypropylene.

14. The hydration system of claim 9, wherein the outer tube and concentric inner tube form an annular volume therebetween and a seat portion interconnecting the inner tube and the outer tube.

15. The hydration system of claim 14, wherein the valve stem includes a lower portion that is partially disposed in the annular volume between the inner tube and the outer tube of the body portion, and wherein the lower portion abuts the seat portion when the valve is in the closed position.

16. The hydration system of claim 15, wherein the valve stem further includes a head portion having a diameter greater than the lower portion, and wherein the head portion abuts the outer tube of the body portion when the valve stem is in the closed position.

* * * * *